US012607416B2

(12) United States Patent
Liu et al.

(10) Patent No.: US 12,607,416 B2
(45) Date of Patent: Apr. 21, 2026

(54) FLOW RATE ADJUSTMENT DEVICE

(71) Applicant: IHI Corporation, Tokyo (JP)

(72) Inventors: Zhihong Liu, Tokyo (JP); Atsushi Ishikawa, Tokyo (JP)

(73) Assignee: IHI CORPORATION, Tokyo (JP)

( * ) Notice: Subject to any disclaimer, the term of this patent is extended or adjusted under 35 U.S.C. 154(b) by 71 days.

(21) Appl. No.: 18/749,967

(22) Filed: Jun. 21, 2024

(65) Prior Publication Data

US 2024/0344779 A1 Oct. 17, 2024

Related U.S. Application Data

(63) Continuation of application No. PCT/JP2022/037910, filed on Oct. 11, 2022.

(30) Foreign Application Priority Data

Jan. 21, 2022 (JP) ..... 2022-008024

(51) Int. Cl.
*F28D 20/00* (2006.01)

(52) U.S. Cl.
CPC .. *F28D 20/0056* (2013.01); *F28D 2020/0073* (2013.01)

(58) Field of Classification Search
CPC ..... F28D 20/0056; F28D 2020/0073
See application file for complete search history.

(56) References Cited

U.S. PATENT DOCUMENTS

| | | | | |
|---|---|---|---|---|
| 4,163,726 | A * | 8/1979 | Wilson | F16K 3/03 55/432 |
| 4,256,100 | A * | 3/1981 | Levy | A61M 16/0081 128/205.15 |
| 4,313,465 | A * | 2/1982 | Holzem | G05B 11/18 251/129.05 |
| 4,382,450 | A * | 5/1983 | Tennick | F16K 3/10 251/298 |
| 4,473,175 | A * | 9/1984 | Zengaffinen | B65G 47/19 222/452 |
| 8,555,920 | B2 * | 10/2013 | Hirata | G05D 7/0664 137/601.18 |
| 2020/0149825 | A1 | 5/2020 | Liu | |

FOREIGN PATENT DOCUMENTS

| | | | |
|---|---|---|---|
| CN | 209752381 | U | 12/2019 |
| CN | 110701927 | A | 1/2020 |
| EP | 0 453 209 | A1 | 4/1991 |
| JP | H03-296430 | A | 12/1991 |
| JP | 2009-112902 | A | 5/2009 |
| JP | 2010-223400 | A | 10/2010 |
| JP | 2013-145080 | A | 7/2013 |
| JP | 2016-088672 | A | 5/2016 |
| WO | 2019/097932 | A1 | 5/2019 |

* cited by examiner

*Primary Examiner* — Eric Keasel

(57) ABSTRACT

A flow rate adjustment device includes: an adjustment unit including a pipe and a sealing plate provided below an outlet of the pipe, the sealing plate having a sealing surface; and a moving unit that moves the sealing plate to a sealing position where the sealing surface of the sealing plate is positioned vertically below the outlet of the pipe and a retraction position where the sealing surface of the sealing plate is retracted from a point vertically below the outlet of the pipe.

16 Claims, 9 Drawing Sheets

FLOW RATE ADJUSTMENT DEVICE

CROSS REFERENCE TO RELATED APPLICATIONS

This application is a continuation application of International Application No. PCT/JP2022/037910, filed on Oct. 11, 2022, which claims priority to Japanese Patent Application No. 2022-008024, filed on Jan. 21, 2022, the entire contents of which are incorporated by reference herein.

BACKGROUND ART

Technical Field

The present disclosure relates to a flow rate adjustment device.

As a flow rate adjustment valve for adjusting a flow rate of solid particles at a high temperature higher than or equal to 500° C., a J valve loop seal including a pot portion in which a fluidized bed of solid particles is formed has been developed (for example, Patent Literature 1).

CITATION LIST

Patent Literature

Patent Literature 1: WO 2019/097932 A

SUMMARY

Technical Problem

It is desired to develop a flow rate adjustment device that adjusts the flow rate of the solid particles, which is different from the above-described J valve loop seal.

An object of the present disclosure is to provide a flow rate adjustment device capable of adjusting a flow rate of solid particles.

Solution to Problem

In order to solve the above problem, a flow rate adjustment device according to one aspect of the present disclosure includes: an adjustment unit including a pipe and a sealing plate provided below an outlet of the pipe, the sealing plate having a sealing surface; and a moving unit that moves the sealing plate to a sealing position where the sealing surface of the sealing plate is positioned vertically below the outlet of the pipe and a retraction position where the sealing surface of the sealing plate is retracted from a point vertically below the outlet of the pipe.

Moreover, the flow rate adjustment device may include a plurality of the adjustment units, and flow path cross-sectional areas of the pipes of the plurality of adjustment units may be at least partially different from each other.

Furthermore, a distance between the outlet of the pipe and the sealing surface of the sealing plate at the sealing position may be larger than or equal to a maximum particle size of solid particles.

In addition, the moving unit may rotate the sealing plate.

In addition, the moving unit may move the sealing plate in a substantially horizontal direction.

Effects

According to the present disclosure, it is possible to adjust the flow rate of solid particles.

DESCRIPTION OF EMBODIMENTS

Embodiments of the present disclosure will be described in detail below with reference to the accompanying drawings. Dimensions, materials, specific numerical values, and others illustrated in such embodiments are merely examples for facilitating understanding, and the present disclosure is not limited thereby except for a case where it is specifically mentioned. Note that, in the present specification and the drawings, components having substantially the same function and structure are denoted by the same symbol, and redundant explanations are omitted. Illustration of components not directly related to the present disclosure is omitted.

[Energy Storage Device 100]

Figure 1:
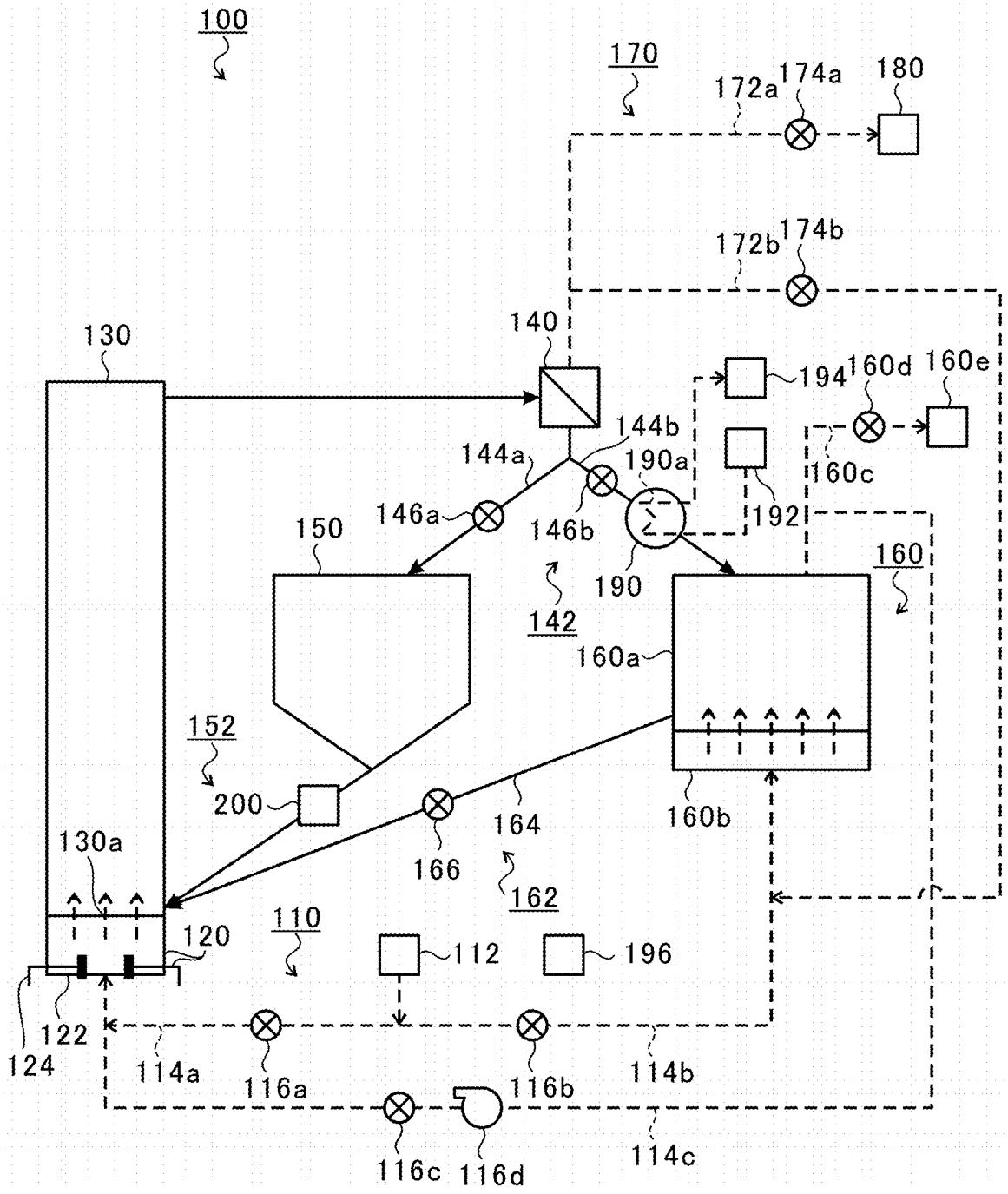
FIG. 1 is a diagram for explaining an energy storage device.

FIG. 1 is a diagram for explaining an energy storage device 100. As illustrated in FIG. 1, the energy storage device 100 includes a gas supply unit 110, a heating chamber 120, a first heat exchanger 130, a solid-gas separator 140, a distribution unit 142, a high-temperature tank 150, a high-temperature particle supply unit 152, a low-temperature tank 160, a low-temperature particle supply unit 162, a gas delivery unit 170, a first heat utilizer 180, a second heat exchanger 190, a fluid supply unit 192, a second heat utilizer 194, and a control unit 196. Incidentally, in FIG. 1, a solid arrow indicates a flow of solid particles or a solid-gas mixture. A broken line arrow indicates a flow of fluid in FIG. 1.

The gas supply unit 110 supplies gas (for example, air) to the heating chamber 120 described later. The gas supply unit 110 includes a blower 112, discharge pipes 114*a*, 114*b*, and

114*c*, valves 116*a*, 116*b*, and 116*c*, and a blower 116*d*. The blower 112 has a suction side connected to a gas supply source and a discharge side connected to the discharge pipe 114*a*. The discharge pipe 114*a* connects the blower 112 and the heating chamber 120. The valve 116*a* is provided in the discharge pipe 114*a*. The discharge pipe 114*b* is branched from between the blower 112 and the valve 116*a* in the discharge pipe 114*a* and is connected to an air box 160*b* of the low-temperature tank 160 described later. The valve 116*b* is provided in the discharge pipe 114*b*. The discharge pipe 114*c* connects a low-temperature housing unit 160*a* of the low-temperature tank 160 to be described later and the heating chamber 120. The valve 116*c* is provided in the discharge pipe 114*c*. The blower 116*d* is provided on the upstream side of the valve 116*c* in the discharge pipe 114*c*.

The heating chamber 120 includes a box 122 and heaters 124. The box 122 is a hollow container. The top surface of the box 122 includes a distributor that enables ventilation. The top surface of the box 122 also functions as a bottom surface of the first heat exchanger 130 described later. Gas is supplied from the gas supply unit 110 (blower 112) to the box 122. A heater 124 consumes power to heat the gas. The heater 124 is, for example, an electric resistance heating device or an arc heating device. The resistance heating device uses heat generated from a conductor to which power is supplied. The arc heating device uses heat generated during arc discharge.

The heaters 124 can consume electric power generated by one or both of a power generation system using renewable energy and a power generation system using a turbine generator. Examples of power generation system using renewable energy includes, for example, a solar thermal power generation system, a solar power generation system, a wind power generation system, and a hydraulic power generation system. Since the heaters 124 consume power generated by a power generation system using renewable energy, it is possible to efficiently convert power that is likely to be in surplus into heat.

The heater 124 is disposed in the box 122. The heater 124 heats the gas supplied into the box 122. Therefore, when the heaters 124 are driven, the gas supplied from the gas supply unit 110 into the box 122 is heated by the heaters 124 and then supplied to the first heat exchanger 130.

The first heat exchanger 130 is supplied with gas and solid particles from the bottom surface or a lower portion and exchanges heat between the gas and the solid particles. The solid particles are made of a material having a melting point higher than a requirement temperature of the first heat utilizer 180 described later.

Examples of solid particles include silica, alumina, barite sand (barite or barium sulfate), partially calcined clay, glass spheres, a recovered petroleum catalyst, and the like. The solid particles are preferably any one or both of silica and alumina. In a case where the solid particles are silica, the cost required for the solid particles can be reduced. In addition, by using desert sand or river sand as the solid particles (silica), the solid particles can be easily obtained at low cost. Alternatively, by using alumina having a relatively high melting point as the solid particles, the solid particles can be heated to a high temperature, whereby a higher storage energy density can be achieved.

The solid particles have particle sizes within a range between 0.01 mm and 10 mm. The shape of the solid particles is not limited and may be spherical or may not be spherical.

In the present embodiment, the first heat exchanger 130 is a hollow container. A heater or a heat exchanger may be installed inside the first heat exchanger 130. The solid particles are supplied to the first heat exchanger 130 from the high-temperature tank 150 and the low-temperature tank 160 described later. As described above, the gas is supplied from the gas supply unit 110 to the first heat exchanger 130 through the heating chamber 120. The flow rate of the gas supplied to the first heat exchanger 130 by the gas supply unit 110 is higher than or equal to a terminal velocity of the solid particles in the first heat exchanger 130. The solid particles are supplied upward from a gas supply port 130*a* formed in the distributor disposed on the bottom surface of the first heat exchanger 130. Therefore, the solid-gas mixture of the solid particles and the gas passes through the first heat exchanger 130 from the lower portion to the upper portion (from the bottom surface to the top surface). In the first heat exchanger 130, a solid-gas mixture of the solid particles and the gas is formed, and the solid particles and the gas are strongly stirred, and thus the solid particles and the gas efficiently come into contact with each other to exchange heat.

The solid-gas separator 140 solid-gas separates the solid-gas mixture discharged from the first heat exchanger 130. The solid-gas separator 140 is, for example, a cyclone or a filter. The distribution unit 142 distributes the solid particles solid-gas separated by the solid-gas separator 140 to the high-temperature tank 150 or the low-temperature tank 160. The distribution unit 142 includes pipes 144*a* and 144*b* and valves 146*a* and 146*b*. The pipe 144*a* connects a discharge port of the solid particles of the solid-gas separator 140 and the high-temperature tank 150. The valve 146*a* is provided in the pipe 144*a*. The pipe 144*b* connects the discharge port of the solid particles of the solid-gas separator 140 and the low-temperature tank 160. The valve 146*b* is provided in the pipe 144*b*. Note that the valve 146*a* and the valve 146*b* are exclusively opened and closed by the control unit 196 to be described later.

The high-temperature tank 150 stores the solid particles solid-gas separated by the solid-gas separator 140. The high-temperature tank 150 is, for example, a hopper. The high-temperature particle supply unit 152 supplies the solid particles stored in the high-temperature tank 150 to the first heat exchanger 130. The high-temperature particle supply unit 152 includes a flow rate adjustment device 200. A specific configuration of the flow rate adjustment device 200 will be described later.

The low-temperature tank 160 stores the solid particles solid-gas separated by the solid-gas separator 140. Solid particles are supplied to the low-temperature tank 160 at timing different from that of the high-temperature tank 150. The low-temperature tank 160 includes a low-temperature housing unit 160*a*, an air box 160*b* (fluidizing gas supply unit), an exhaust pipe 160*c*, and a check valve 160*d*. The low-temperature housing unit 160*a* houses the solid particles supplied by the distribution unit 142. The low-temperature housing unit 160*a* is a hollow container. The air box 160*b* is provided under the low-temperature housing unit 160*a*. An upper portion of the air box 160*b* includes a distributor that enables ventilation. The upper portion of the air box 160*b* also functions as the bottom surface of the low-temperature housing unit 160*a*. A fluidizing gas (for example, air) is supplied from the gas supply unit 110 (blower 112) or the solid-gas separator 140 to the air box 160*b*. The fluidizing gas supplied to the air box 160*b* is supplied from the bottom surface (distributor) of the low-temperature housing unit 160*a* into the low-temperature housing unit 160*a*.

Note that the flow rate of the fluidizing gas supplied from the gas supply unit 110 to the low-temperature housing unit

160*a* is higher than or equal to the minimum fluidization velocity and lower than the scattering velocity of the solid particles. The flow rate of the fluidizing gas supplied from the solid-gas separator 140 to the low-temperature housing unit 160*a* is higher than or equal to the minimum fluidization velocity and lower than the terminal velocity of the solid particles. Therefore, the solid particles supplied from the solid-gas separator 140 are fluidized by the fluidizing gas, and a fluidized bed (bubble fluidized bed) is formed in the low-temperature housing unit 160*a*. In addition, since the flow rate of the fluidizing gas supplied from the solid-gas separator 140 to the low-temperature housing unit 160*a* is less than the terminal velocity, the solid particles are not scattered from the low-temperature housing unit 160*a*.

The exhaust pipe 160*c* connects the low-temperature housing unit 160*a* and a pressure energy recovery unit 160*e*. The check valve 160*d* is provided in the exhaust pipe 160*c*. The check valve 160*d* is opened when the pressure in the low-temperature housing unit 160*a* reaches or exceeds a predetermined pressure. When the low-temperature housing unit 160*a* is in a pressurized state, the pressure of the gas exhausted from the exhaust pipe 160*c* is higher than or equal to the atmospheric pressure. In this case, the pressure energy recovery unit 160*e* is, for example, a turbine.

The low-temperature particle supply unit 162 supplies the solid particles stored in the low-temperature tank 160 to the first heat exchanger 130. The low-temperature particle supply unit 162 includes a pipe 164 and a flow rate adjustment valve 166. The pipe 164 connects the lower portion of the low-temperature housing unit 160*a* and the lower portion of the first heat exchanger 130. The flow rate adjustment valve 166 is provided in the pipe 164.

The gas delivery unit 170 supplies the gas solid-gas separated by the solid-gas separator 140 to the first heat utilizer 180 or the air box 160*b*. The gas delivery unit 170 includes pipes 172*a* and 172*b* and valves 174*a* and 174*b*. The pipe 172*a* connects an exhaust port of gas of the solid-gas separator 140 and the first heat utilizer 180. The valve 174*a* is provided in the pipe 172*a*. The pipe 172*b* connects the exhaust port of gas of the solid-gas separator 140 and the air box 160*b*. The valve 174*b* is provided in the pipe 172*b*.

The first heat utilizer 180 is a device that utilizes the thermal energy of the gas separated by the solid-gas separator 140. The first heat utilizer 180 is, for example, a gas turbine generator, a steam turbine generator (boiler), a boiler that provides steam, a furnace (or a kiln), or an air conditioner.

The second heat exchanger 190 is provided between the valve 146*b* in the pipe 144*b* and the low-temperature housing unit 160*a*. The second heat exchanger 190 exchanges heat between the solid particles passing through the pipe 144*b* and a fluid (for example, water, water vapor, air, or combustion exhaust gas). The second heat exchanger 190 may be configured to form a fluidized bed of solid particles or may be configured to form a moving bed of solid particles. The second heat exchanger 190 includes a heat transfer pipe 190*a*. The heat transfer pipe 190*a* passes among the solid particles (in the fluidized bed or the moving bed of the solid particles). The fluid passes through the heat transfer pipe 190*a*. The fluid supply unit 192 causes the fluid to pass through the second heat exchanger 190 and supplies the fluid, having been subjected to heat exchange (heating) by the second heat exchanger 190, to the second heat utilizer 194. The fluid supply unit 192 is, for example, a pump.

The second heat utilizer 194 is a device that utilizes thermal energy of the fluid heated by the second heat exchanger 190. The second heat utilizer 194 is, for example, a gas turbine generator, a steam turbine generator (boiler), a boiler that provides steam, a furnace (or a kiln), or an air conditioner.

The control unit 196 includes a semiconductor integrated circuit including a central processing unit (CPU). The control unit 196 reads, from a ROM, programs, parameters, and the like for causing the CPU to operate. The control unit 196 manages and controls the entire energy storage device 100 in cooperation with a RAM as a work area or other electronic circuits.

In the present embodiment, the control unit 196 controls the gas supply unit 110 (the blower 112, the valves 116*a*, 116*b*, and 116*c*, and the blower 116*d*), the heaters 124, the distribution unit 142 (the valves 146*a* and 146*b*), the high-temperature particle supply unit 152 (flow rate adjustment device 200), the low-temperature particle supply unit 162 (the flow rate adjustment valve 166), the gas delivery unit 170 (the valves 174*a* and 174*b*), and the fluid supply unit 192.

In the present embodiment, the control unit 196 converts surplus power into thermal energy and stores the thermal energy during a period in which the power is in surplus (amount of generated power−amount of power in demand >predetermined value (e.g. 0)) (heat storage mode). On the other hand, when heat or electric power is required, the control unit 196 uses the stored thermal energy in the first heat utilizer 180 and/or the second heat utilizer 194 (heat dissipation mode).

Note that the processing by the control unit 196 in each of the heat storage mode and the heat dissipation mode is known technology such as technology disclosed in WO 2019/097932 A, and thus detailed description thereof will be omitted here.

[Flow Rate Adjustment Device 200]

Next, the flow rate adjustment device 200 according to the present embodiment will be described. The flow rate adjustment device 200 adjusts the flow rate of solid particles flowing from the upper side to the lower side. In the present embodiment, the flow rate adjustment device 200 adjusts the flow rate of the solid particles flowing from the high-temperature tank 150 towards the first heat exchanger 130.

Figure 2:
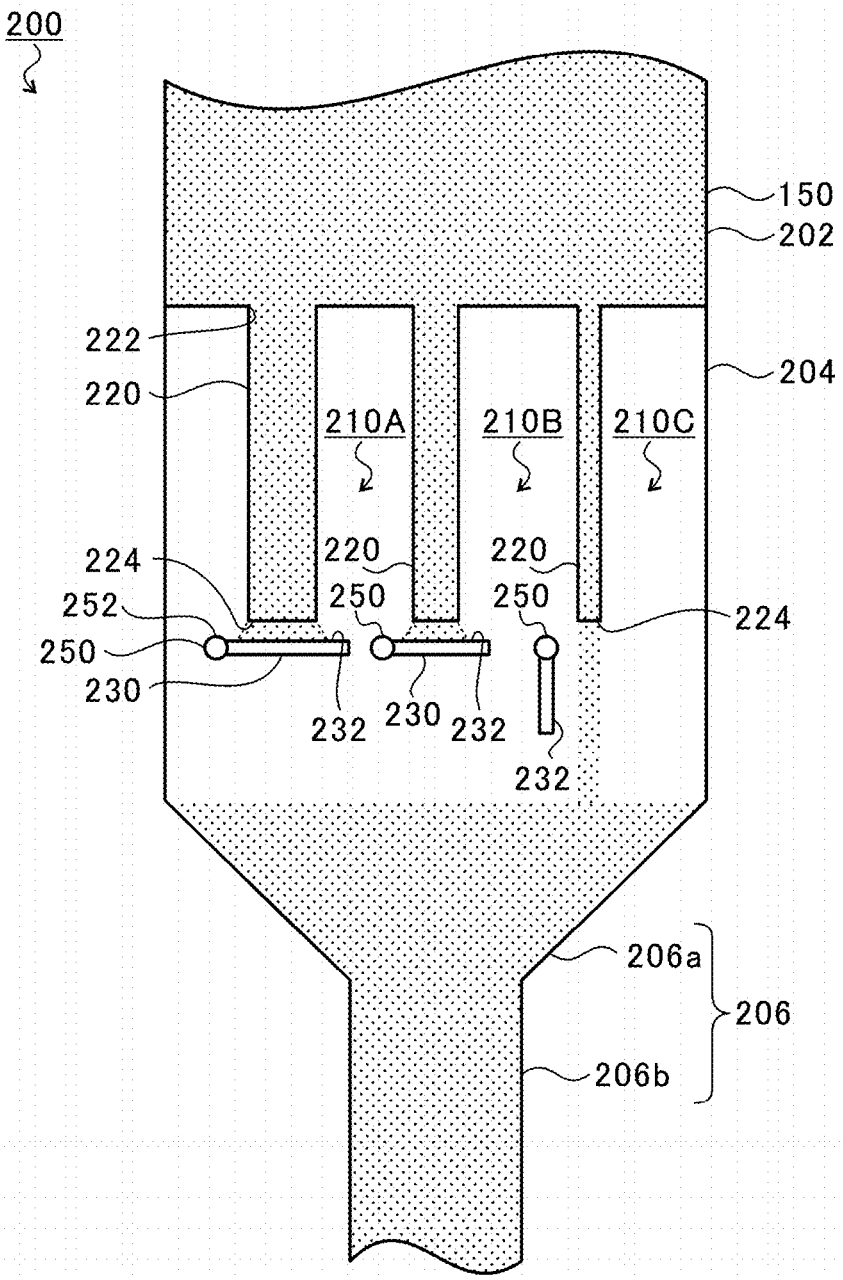
FIG. 2 is a diagram for explaining a flow rate adjustment device according to the present embodiment.

FIG. 2 is a diagram for explaining the flow rate adjustment device 200 according to the present embodiment. As illustrated in FIG. 2, the flow rate adjustment device 200 includes an upstream storage unit 202, a communicating portion 204, a downstream storage unit 206, a plurality of adjustment units 210A to 210C, and moving units 250.

The upstream storage unit 202 stores solid particles. In the present embodiment, the upstream storage unit 202 functions as the high-temperature tank 150.

The communicating portion 204 is a cylindrical member extending in the vertical direction. The communicating portion 204 is continuous with a lower portion of the upstream storage unit 202 (the high-temperature tank 150).

The downstream storage unit 206 is a cylindrical member extending in the vertical direction. The downstream storage unit 206 includes a reducing diameter portion 206*a* and a constant diameter portion 206*b*. The reducing diameter portion 206*a* is continuous with a lower portion of the communicating portion 204. The inner diameter of the reducing diameter portion 206*a* gradually decreases as it extends from the upper portion to the lower portion. The constant diameter portion 206*b* is continuous with a lower portion of the reducing diameter portion 206*a*. The inner diameter of the constant diameter portion 206*b* is constant from an upper portion to a lower portion. The constant diameter portion 206*b* is connected to a lower portion of the first heat exchanger 130.

The communicating portion 204 and the downstream storage unit 206 have a heat insulating structure.

The adjustment units 210A to 210C are provided in the communicating portion 204. The adjustment units 210A to 210C each have a pipe 220 and a sealing plate 230. Note that the adjustment units 210A to 210C have substantially equivalent structures except that the inner diameters of the pipes 220 are different from each other.

The pipes 220 extend in the vertical direction. In the present embodiment, the inner diameters of the pipes 220 are substantially constant. An inlet 222 of a pipe 220 is connected to the upstream storage unit 202 (high-temperature tank 150). An outlet 224 of the pipe 220 is provided below the inlet 222.

In the present embodiment, the inner diameter of the pipe 220 of the adjustment unit 210B is smaller than the inner diameter of the pipe 220 of the adjustment unit 210A. That is, the flow path cross-sectional area of the pipe 220 of the adjustment unit 210B is smaller than the flow path cross-sectional area of the pipe 220 of the adjustment unit 210A. Likewise, the inner diameter of the pipe 220 of the adjustment unit 210C is smaller than the inner diameter of the pipe 220 of the adjustment unit 210B. That is, the flow path cross-sectional area of the pipe 220 of the adjustment unit 210C is smaller than the flow path cross-sectional area of the pipe 220 of the adjustment unit 210B.

For example, the flow path cross-sectional area of the pipe 220 of the adjustment unit 210B is ½ of the flow path cross-sectional area of the pipe 220 of the adjustment unit 210A. The flow path cross-sectional area of the pipe 220 of the adjustment unit 210C is ¼ ($(1/2)^2$) of the flow path cross-sectional area of the pipe 220 of the adjustment unit 210A. That is, the pipe 220 of the adjustment unit 210A, the pipe 220 of the adjustment unit 210B, and the pipe 220 of the adjustment unit 210C have different flow rates of the passing solid particles. For example, letting the flow rate of the pipe 220 of the adjustment unit 210A be 1, the flow rate of the pipe 220 of the adjustment unit 210B is ½, and the flow rate of the pipe 220 of the adjustment unit 210C is ¼.

A sealing plate 230 is provided below the outlet 224 of the pipe 220. The sealing plate 230 has a sealing surface 232 extending in a substantially horizontal direction at a sealing position described later.

The moving unit 250 moves the sealing plate 230 to the sealing position and a retraction position. The sealing position is a position where the sealing surface 232 of the sealing plate 230 is positioned vertically below the outlet 224 of the pipe 220. As illustrated in FIG. 2, the sealing plates 230 of the adjustment unit 210A and the adjustment unit 210B are arranged at the sealing positions.

On the other hand, the retraction position is a position where the sealing surface 232 of the sealing plate 230 is retracted from a point vertically below the outlet 224 of the pipe 220. As illustrated in FIG. 2, the sealing plate 230 of the adjustment unit 210C is disposed at the retraction position.

The moving units 250 move the sealing plate 230 of the adjustment unit 210A, the sealing plate 230 of the adjustment unit 210B, and the sealing plate 230 of the adjustment unit 210C in a mutually independent manner.

In the present embodiment, the moving unit 250 rotates the sealing plate 230 in an up-down direction to move the sealing plate 230 to the sealing position and the retraction position. The moving unit 250 includes, for example, a rotation shaft 252 and an actuator (not illustrated). The rotation shaft 252 is provided at one end of the sealing plate 230. The rotation shaft 252 extends in a substantially horizontal direction.

The actuator rotates the rotation shaft 252. The actuator includes, for example, a motor. Note that the actuator may be included in the communicating portion 204 or may be provided outside the communicating portion 204. Note that the actuator may be cooled (for example, water cooling).

Figure 3:
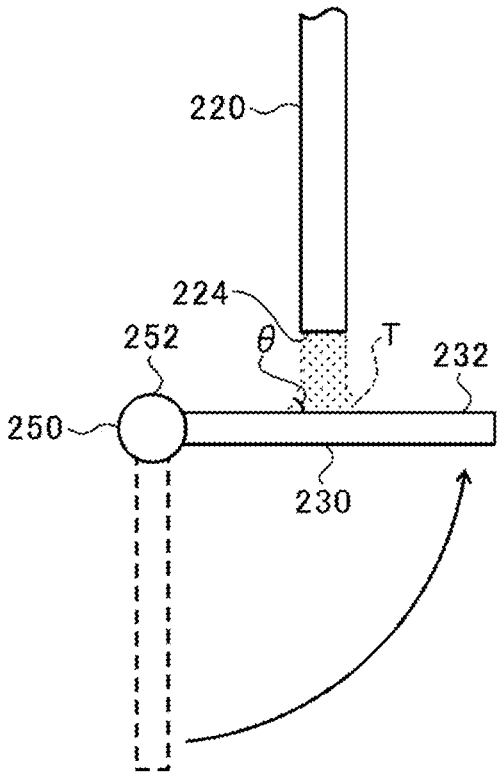
FIG. 3 is a first diagram for explaining a state of solid particles at a sealing position.
Figure 4:
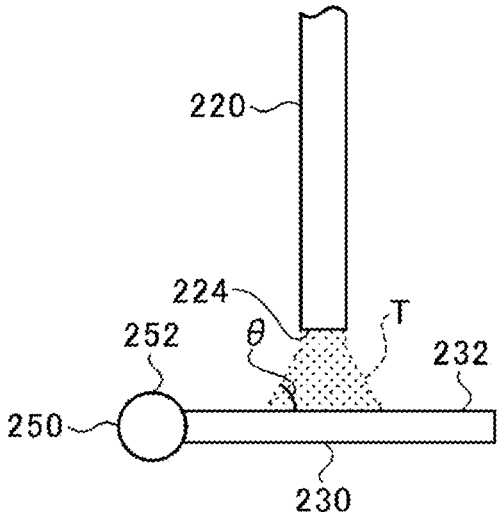
FIG. 4 is a second diagram for explaining a state of solid particles at the sealing position.
Figure 5:
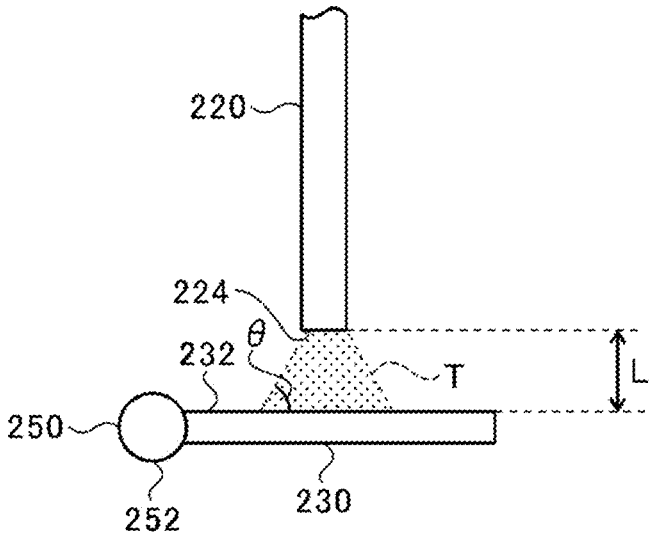
FIG. 5 is a third diagram for explaining a state of solid particles at the sealing position.

FIGS. 3 to 5 are diagrams for explaining a state of solid particles at the sealing position. As illustrated in FIG. 3, when the sealing plate 230 is moved from the retraction position to the sealing position (indicated by an arrow in FIG. 3), the solid particles flowing down from the outlet 224 of the pipe 220 are deposited on the sealing plate 230. The deposited solid particles have a conical shape while maintaining an angle of repose θ. Note that the angle of repose θ is an angle formed by the conical slope and the sealing surface 232.

Since the solid particles continue to flow from the outlet 224, as illustrated in FIG. 4, the solid particles deposit (pile up) on the sealing plate 230 while maintaining the angle of repose θ. Incidentally, the size of the conical deposit T formed by the solid particles increases as time elapses after switching from the retraction position to the sealing position. That is, as the elapsed time becomes longer, the contact area between the deposit T and the sealing surface 232 (the size of the bottom surface of the deposit T) becomes larger.

Then, as illustrated in FIG. 5, when the top portion of the deposit T reaches the outlet 224 and the outlet 224 is filled with the deposit T, the outlet 224 is sealed by the deposit T. This stops falling of the solid particles downward from the outlet 224.

That is, by disposing the sealing plate 230 at the sealing position, the flow of the solid particles from the pipe 220 can be stopped.

Note that a distance L (shortest distance) between the outlet 224 and the sealing surface 232 at the sealing position is greater than or equal to the maximum particle size of the solid particles. The distance L is, for example, greater than or equal to about 10 times the particle size (for example, the maximum particle size) of the solid particles. If the distance L is too small, the outlet 224 and the sealing surface 232 slide against each other and wear. Therefore, by setting the distance L to be larger than or equal to the maximum particle size of the solid particles, abrasion of the outlet 224 and the sealing surface 232 can be prevented.

The maximum value of the distance L is determined on the basis of the size of the sealing surface 232. Specifically describing, the distance L is a value at which the area of the bottom surface of the deposit T is less than the area of the sealing surface 232 when the outlet 224 is filled with the deposit T.

Figure 6:
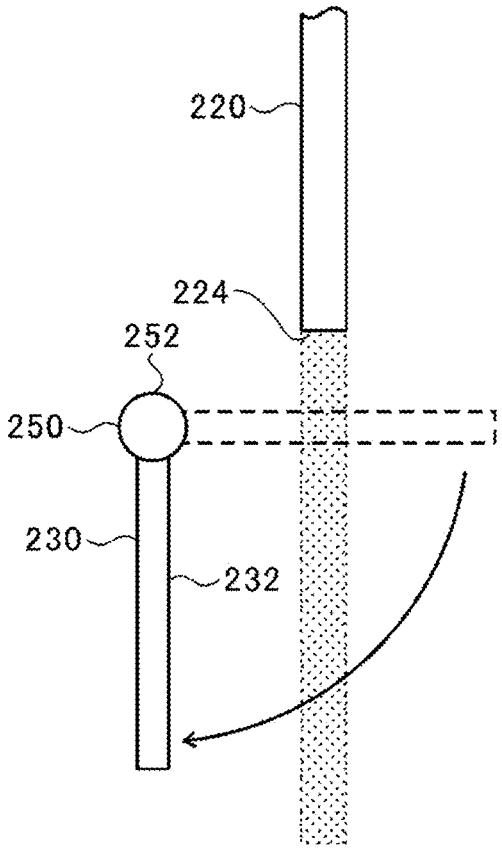
FIG. 6 is a diagram for explaining a state of solid particles at a retraction position.

FIG. 6 is a diagram for explaining a state of the solid particles at the retraction position. As illustrated in FIG. 6, when the sealing plate 230 is moved from the sealing position to the retraction position (indicated by an arrow in FIG. 6), the deposit T formed on the sealing surface 232 of the sealing plate 230 falls into the downstream storage unit 206, thereby releasing the sealing of the outlet 224 by the deposit T. In this manner, falling of the solid particles through the pipe 220 (outlet 224) is resumed.

Note that the moving unit 250 is driven by the control unit 196. The control unit 196 can adjust the flow rate of the solid particles supplied from the high-temperature tank 150 (upstream storage unit 202) to the first heat exchanger 130 by only moving any one or a plurality of the sealing plates 230 of the adjustment units 210A to 210C from the sealing position to the retraction position. Note that the control unit 196 can stop the supply of the solid particles from the high-temperature tank 150 (upstream storage unit 202) to the first heat exchanger 130 by positioning all the sealing plates 230 of the adjustment units 210A to 210C at the sealing positions.

As described above, the flow rate adjustment device 200 according to the present embodiment includes the adjustment units 210A to 210C and the moving units 250. As a result, the flow rate adjustment device 200 can adjust the flow rate of the solid particles with a simple configuration such as merely moving the sealing plates 230 to the sealing position or the retraction position.

In addition, since the flow rate adjustment device 200 merely moves the sealing plates 230 to the sealing position or the retraction position, it is possible to adjust the flow rate of the solid particles having a high temperature higher than or equal to 500° C. Furthermore, the flow rate adjustment device 200 can adjust the flow rate of a large amount of solid particles such as 1 t/sec.

In addition, the moving units 250 can move the sealing plates 230 to the sealing position or the retraction position by only rotating the sealing plates 230.

First Modification: Circulating Fluidized Bed Gasifier 300

Figure 7:
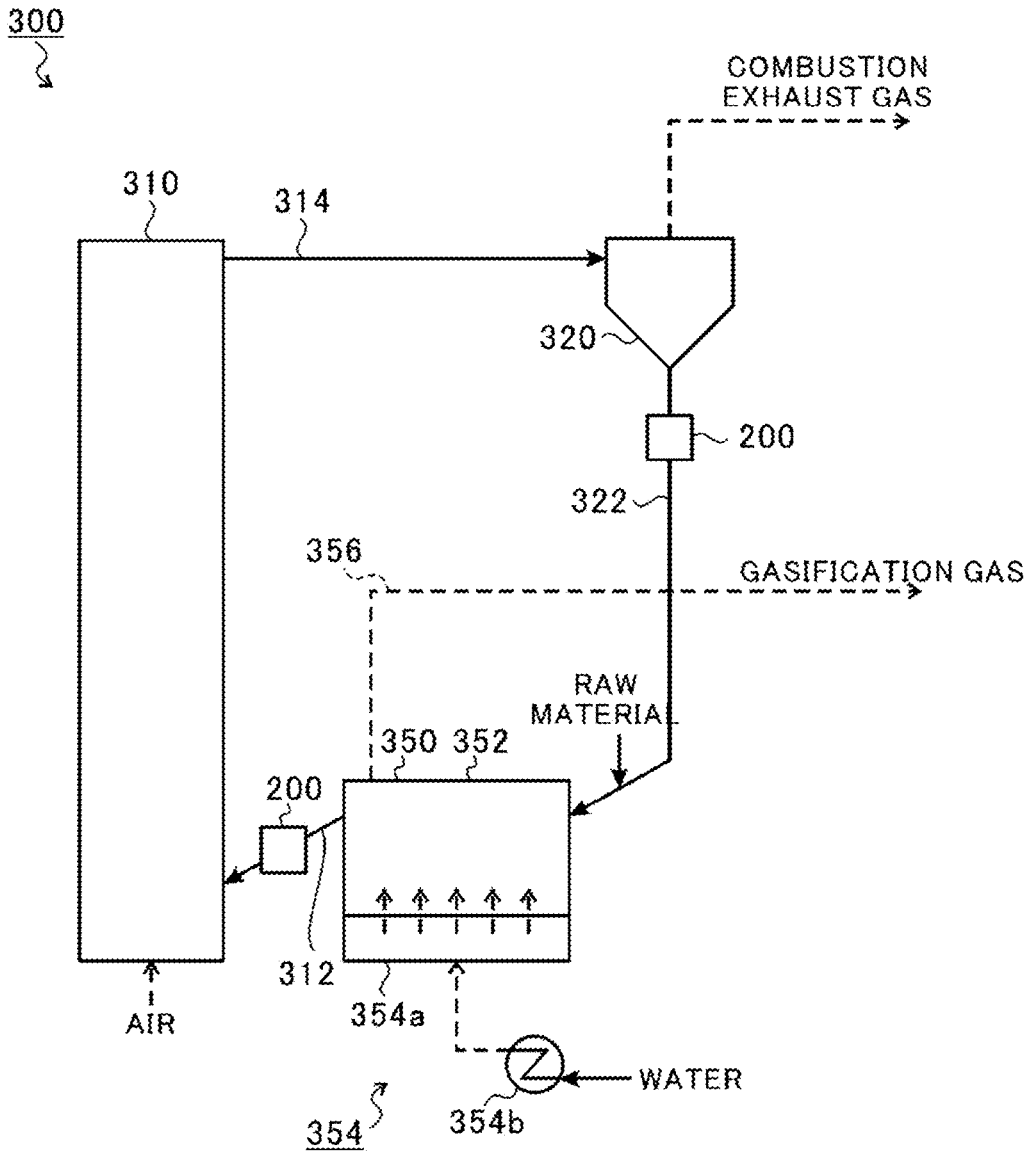
FIG. 7 is a diagram for explaining a circulating fluidized bed gasifier according to a first modification.

FIG. 7 is a diagram for explaining a circulating fluidized bed gasifier 300 according to a first modification. In FIG. 7, a solid arrow indicates a flow of solid particles (a fluid medium, a raw material, and a residue) and liquid (water). In FIG. 7, a broken line arrow indicates a flow of gas (steam, gasification gas, air, and combustion exhaust gas).

As illustrated in FIG. 7, the circulating fluidized bed gasifier 300 includes a combustion furnace 310, a cyclone 320, a gasification furnace 350, and flow rate adjustment devices 200. Components that are substantially the same as those of the energy storage device 100 described above are denoted by the same symbol, and description thereof will be omitted.

The circulating fluidized bed gasifier 300 gasifies a raw material using a fluidized bed of a fluid medium (solid particles) to produce a gasification gas (synthesis gas). The raw material is, for example, a solid raw material such as coal (brown coal or the like) or biomass (wood pellets or the like). The circulating fluidized bed gasifier 300 is a circulating fluidized bed type gasification system. That is, the circulating fluidized bed gasifier 300 circulates the fluid medium as a heat medium in the combustion furnace 310, the cyclone 320, and the gasification furnace 350. The fluid medium is, for example, a mineral such as silica sand or olivine having a particle size of about 300 μm.

The combustion furnace 310 has a cylindrical shape. Fuel and the fluid medium are introduced into the combustion furnace 310 from the gasification furnace 350 described later through an introduction pipe 312. The introduction pipe 312 connects the lower portion of the combustion furnace 310 and the gasification furnace 350. The combustion furnace 310 burns the fuel to heat the fluid medium to a range between 600° C. and 1000° C. The combustion exhaust gas and the fluid medium heated in the combustion furnace 310 are delivered to the cyclone 320 through a discharge pipe 314. The discharge pipe 314 connects an upper portion of the combustion furnace 310 and the cyclone 320.

The cyclone 320 solid-gas separates a mixture of the fluid medium and the combustion exhaust gas introduced from the combustion furnace 310 through the discharge pipe 314. The high-temperature fluid medium separated by the cyclone 320 is introduced into the gasification furnace 350 through a supply pipe 322. The supply pipe 322 connects a bottom portion of the cyclone 320 and the gasification furnace 350.

The high-temperature fluid medium is fluidized by a fluidizing gas (for example, water vapor) in the gasification furnace 350. Specifically describing, the gasification furnace 350 includes a housing tank 352 and a water vapor introduction unit 354. The housing tank 352 stores the fluid medium and the raw material.

The water vapor introduction unit 354 introduces water vapor into the housing tank 352. The water vapor introduction unit 354 includes an air box 354*a* and a boiler 354*b*. The air box 354*a* is provided under the housing tank 352. An upper portion of the air box 354*a* also functions as the bottom surface of the housing tank 352. The upper portion of the air box 354*a* includes a distributor that enables ventilation. The boiler 354*b* generates water vapor. The boiler 354*b* is connected to the air box 354*a*. The water vapor generated by the boiler 354*b* is introduced into the air box 354*a*. The water vapor introduced into the air box 354*a* is introduced into the housing tank 352 from the bottom surface (distributor) of the housing tank 352. The boiler 354*b* introduces water vapor into the air box 354*a* at a flow rate that enables a fluidized bed of a fluid medium to be formed in the housing tank 352. Therefore, the high-temperature fluid medium introduced from the cyclone 320 is fluidized by water vapor. As a result, the fluidized bed (for example, bubbling fluidized bed) of the fluid medium is formed in the housing tank 352.

The raw material is introduced into the gasification furnace 350 (housing tank 352) through the supply pipe 322. The introduced raw material is gasified by heat of the fluid medium within a range of 600° C. and 900° C., whereby a gasification gas (synthesis gas) is produced. The gasification gas produced in the gasification furnace 350 is delivered to a gasification gas utilization facility as an output stage through a delivery pipe 356.

As described above, the fluid medium fluidized in the gasification furnace 350 is returned to the combustion furnace 310 through the introduction pipe 312 connecting the gasification furnace 350 and the combustion furnace 310. As described above, in the circulating fluidized bed gasifier 300 according to the present embodiment, the fluid medium moves through the combustion furnace 310, the cyclone 320, and the gasification furnace 350 in this order and is introduced into the combustion furnace 310 again to circulate therethrough.

The residue of the raw material is introduced into the combustion furnace 310 from the gasification furnace 350 through the introduction pipe 312. The residue of the raw material is used as fuel in the combustion furnace 310. The residue of the raw material is what remains without being gasified in the gasification furnace 350 from the raw material.

In the first modification, the flow rate adjustment devices 200 are provided in the introduction pipe 312 and the supply pipe 322. The flow rate adjustment devices 200 are controlled on the basis of, for example, a retention time of the raw material in the gasification furnace 350, the temperature of the gasification furnace 350, and the pressure of the gasification furnace 350.

As described above, in the first modification, the flow rate adjustment devices 200 can adjust the flow rate of the fluid medium (solid particles) at a high temperature higher than or equal to 500° C.

Note that, in the first modification, the case where the flow rate adjustment devices 200 are provided in the supply pipe 322 and the introduction pipe 312 has been described as an example. However, the flow rate adjustment device 200 may be provided in the introduction pipe 312 or the supply pipe 322.

Second Modification: Circulating Fluidized Bed Boiler 400

Figure 8:
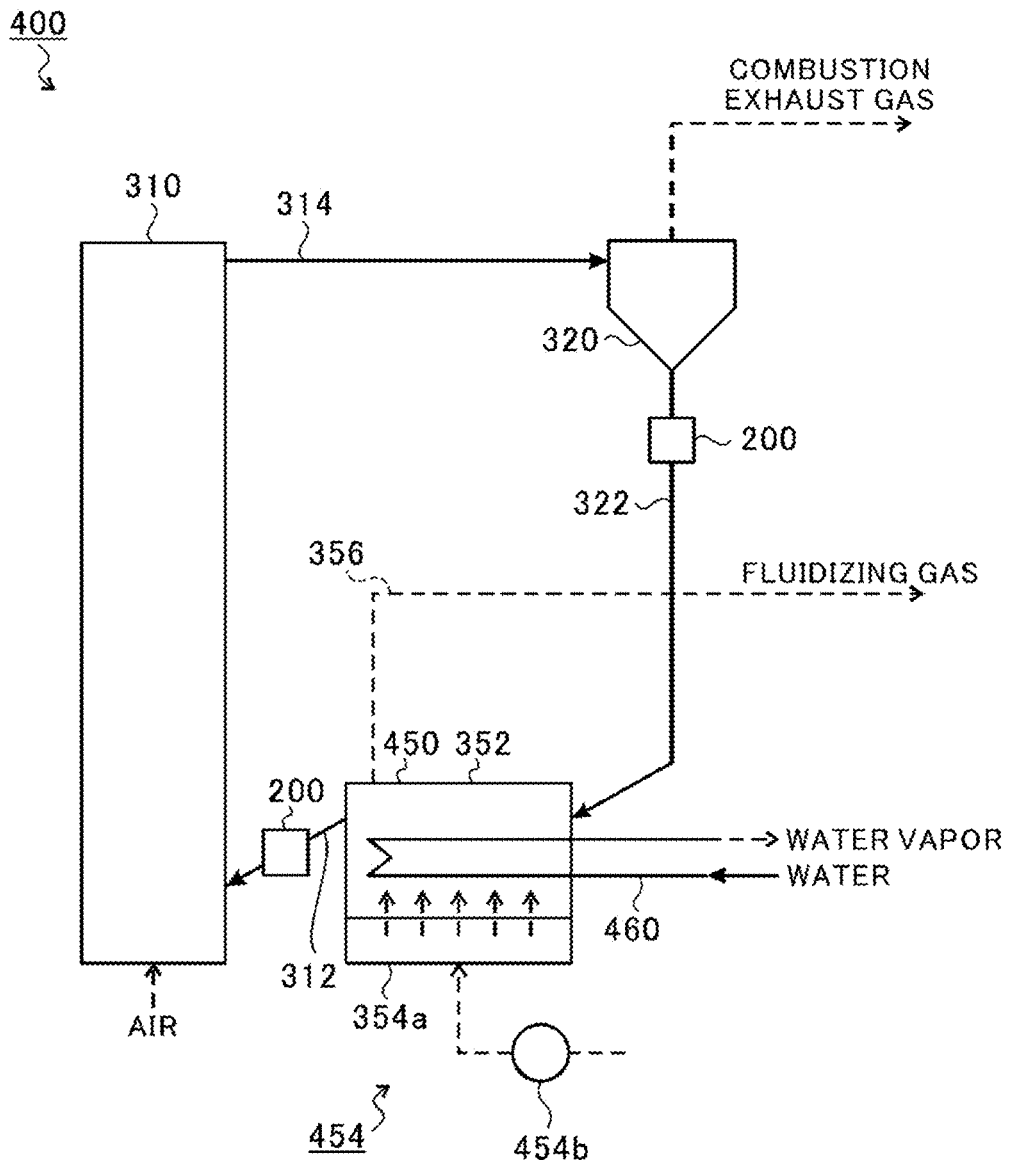
FIG. 8 is a diagram for explaining a circulating fluidized bed boiler according to a second modification.

FIG. 8 is a diagram for explaining a circulating fluidized bed boiler 400 according to a second modification. Note that, in FIG. 8, a solid arrow indicates a flow of solid particles (fluid medium) and liquid (water). Meanwhile, in FIG. 8, a broken line arrow indicates a flow of gas (water vapor, air, and combustion exhaust gas).

As illustrated in FIG. 8, a circulating fluidized bed boiler 400 includes a combustion furnace 310, a cyclone 320, a fluidized bed furnace 450, a heat transfer pipe 460, and flow rate adjustment devices 200. Note that components that are substantially the same as those of the energy storage device 100 or the circulating fluidized bed gasifier 300 described above are denoted by the same symbol, and description thereof will be omitted.

In the second modification, a high-temperature fluid medium separated by the cyclone 320 is introduced into the fluidized bed furnace 450 through a supply pipe 322. The supply pipe 322 connects a bottom portion of the cyclone 320 and the fluidized bed furnace 450.

The high-temperature fluid medium is fluidized by a fluidizing gas (for example, air, water vapor, or carbon dioxide ($CO_2$)) in the fluidized bed furnace 450. Specifically describing, the fluidized bed furnace 450 includes a housing tank 352 and a fluidizing gas introduction unit 454.

The fluidizing gas introduction unit 454 introduces the fluidizing gas into the housing tank 352. The fluidizing gas introduction unit 454 includes an air box 354*a* and a pump 454*b*.

The pump 454*b* is connected to the air box 354*a*. The pump 454*b* introduces the fluidizing gas into the air box 354*a*. The fluidizing gas introduced into the air box 354*a* is introduced into the housing tank 352 from the bottom surface (distributor) of the housing tank 352. The pump 454*b* introduces the fluidizing gas into the air box 354*a* at a flow rate that enables a fluidized bed of a fluid medium to be formed in the housing tank 352. Therefore, the high-temperature fluid medium introduced from the cyclone 320 is fluidized by the fluidizing gas. As a result, the fluidized bed (for example, bubbling fluidized bed) of the fluid medium is formed in the housing tank 352.

As described above, the fluid medium fluidized in the fluidized bed furnace 450 is returned to the combustion furnace 310 through an introduction pipe 312 connecting the fluidized bed furnace 450 and the combustion furnace 310. As described above, in the circulating fluidized bed boiler 400 according to the present embodiment, the fluid medium moves through the combustion furnace 310, the cyclone 320, and the fluidized bed furnace 450 in this order and is introduced into the combustion furnace 310 again to circulate therethrough.

In the second modification, the heat transfer pipe 460 is included in the fluidized bed furnace 450 (housing tank 352). Water is supplied to the heat transfer pipe 460. In the heat transfer pipe 460, heat is exchanged between a high-temperature fluid medium and water, and the water is evaporated to generate water vapor. The generated water vapor is sent to a water vapor utilization facility as an output stage.

In the second modification, the flow rate adjustment devices 200 are provided in the introduction pipe 312 and the supply pipe 322. The flow rate adjustment device 200 provided in the introduction pipe 312 is controlled on the basis of the pressure and the temperature of the combustion furnace 310. The flow rate adjustment device 200 provided in the supply pipe 322 is controlled on the basis of a required heat quantity of the water vapor utilization facility.

As described above, in the second modification, the flow rate adjustment devices 200 can adjust the flow rate of the fluid medium (solid particles) at a high temperature higher than or equal to 500° C.

Third Modification: Solar Thermal Power Generation System 500

Figure 9:
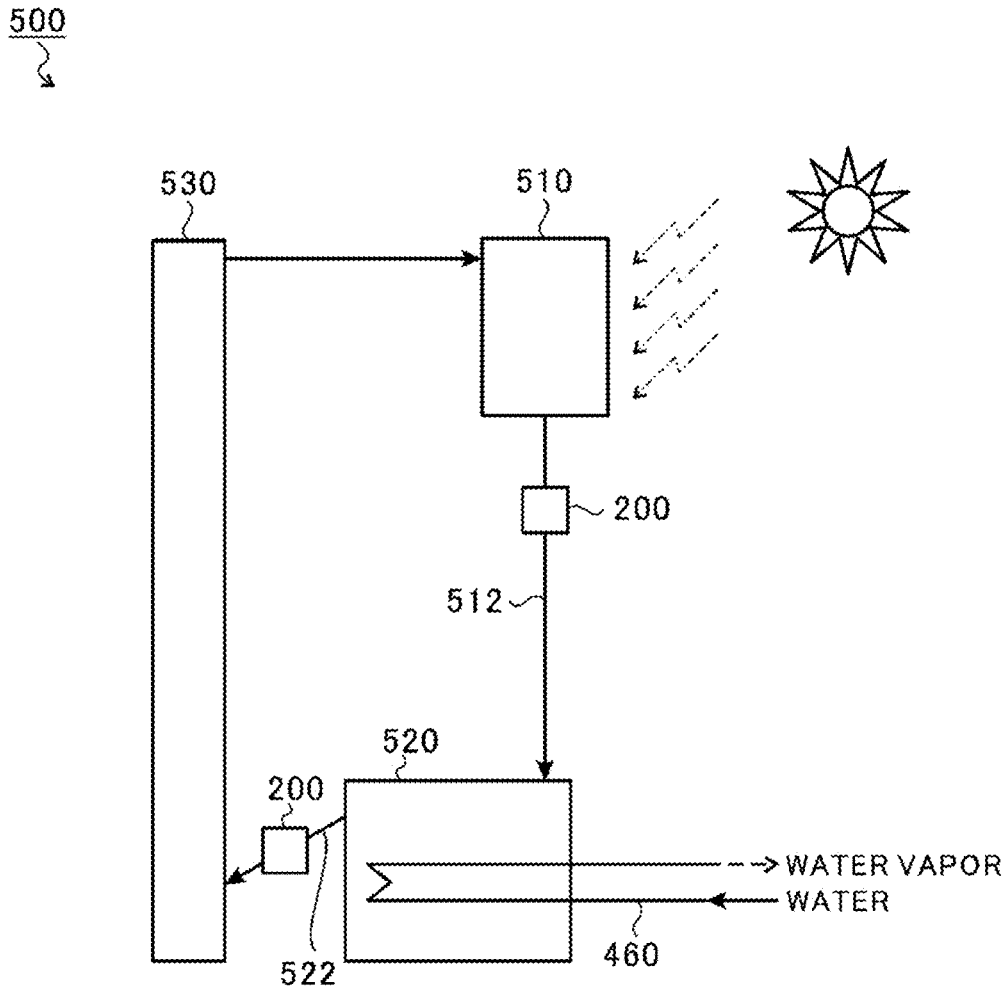
FIG. 9 is a diagram for explaining a solar thermal power generation system according to a third modification.

FIG. 9 is a diagram illustrating a solar thermal power generation system 500 according to a third modification. Incidentally, in FIG. 9, a solid arrow indicates a flow of solid particles or water. Meanwhile, in FIG. 9, a broken line arrow indicates a flow of water vapor. Furthermore, in FIG. 9, an arrow of a one-dot chain line indicates sunlight.

As illustrated in FIG. 9, the solar thermal power generation system 500 includes a condenser 510, a heat exchanger 520, a heat transfer pipe 460, a conveyance mechanism 530, and flow rate adjustment devices 200. Note that components that are substantially the same as those of the energy storage device 100 or the circulating fluidized bed boiler 400 described above are denoted by the same symbol, and description thereof will be omitted.

The condenser 510 condenses sunlight to heat solid particles. The solid particles heated by the condenser 510 are supplied to the heat exchanger 520 through a supply pipe 512. The supply pipe 512 connects a bottom portion of the condenser 510 and an upper portion of the heat exchanger 520.

The heat exchanger 520 temporarily stores the high-temperature solid particles supplied from the condenser 510 through the supply pipe 512. A discharge pipe 522 is connected to an upper portion of the heat exchanger 520. The solid particles are discharged from the discharge pipe 522 to the conveyance mechanism 530. Therefore, the high-temperature solid particles move from top to bottom in the heat exchanger 520. That is, a moving bed of the solid particles is formed in the heat exchanger 520.

The conveyance mechanism 530 conveys the solid particles discharged from the discharge pipe 522 to the condenser 510. The conveyance mechanism 530 is, for example, a screw lift or an elevator.

As described above, in the solar thermal power generation system 500, the solid particles move through the condenser 510, the heat exchanger 520, and the conveyance mechanism 530 in this order and are introduced into the condenser 510 again to circulate therethrough.

In the third modification, the heat transfer pipe 460 is included in the heat exchanger 520. Water is supplied to the heat transfer pipe 460. In the heat transfer pipe 460, heat is exchanged between a high-temperature fluid medium and water, and the water is evaporated to generate water vapor. The generated water vapor is sent to a power generator as an output stage.

In the third modification, the flow rate adjustment devices 200 are provided in the supply pipe 512 and in the discharge pipe 522. The flow rate adjustment devices 200 are controlled on the basis of a required power of the power generator.

As described above, in the third modification, the flow rate adjustment devices 200 can adjust the flow rate of the solid particles at a high temperature higher than or equal to 500° C.

Fourth Modification

In the above embodiment, the case where the rotation shafts 252 included in the moving units 250 are provided at one ends of the sealing plates 230 has been described as an example. However, in a moving unit 250, the position of a rotation shaft 252 is not limited as long as a sealing plate 230 can be rotated.

Figure 10:
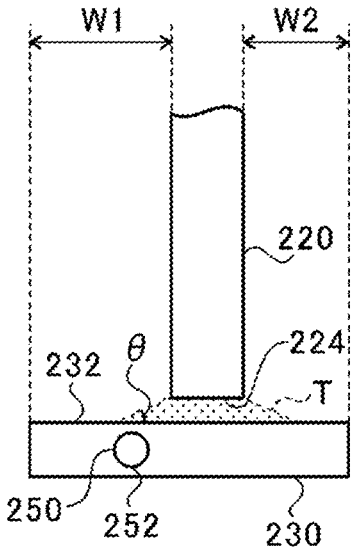
FIG. 10 is a diagram for explaining a moving unit according to a fourth modification at a sealing position.
Figure 11:
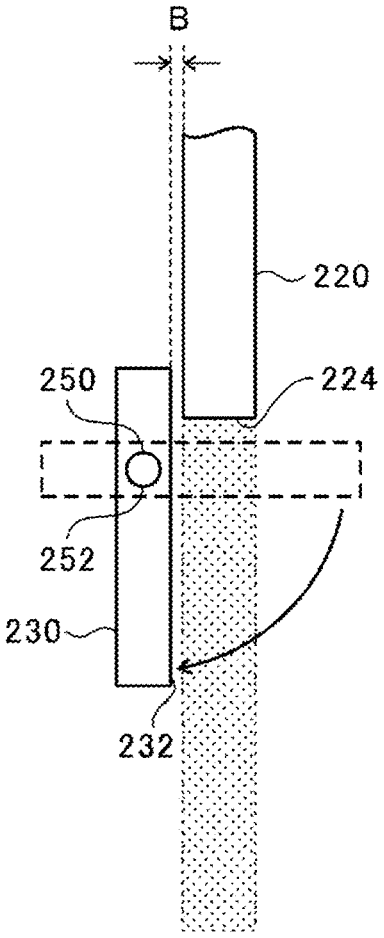
FIG. 11 is a diagram for explaining a moving unit according to the fourth modification at a retraction position.

FIG. 10 is a diagram for explaining a moving unit 250 according to a fourth modification at the sealing position. FIG. 11 is a diagram for explaining the moving unit 250 according to the fourth modification at the retraction position.

As illustrated in FIGS. 10 and 11, the rotation shaft 252 according to the fourth modification is included between one end and the other end of the sealing plate 230. As illustrated in FIG. 10, at the sealing position, a width W1 between one end of the sealing plate 230 and one end side of a pipe 220 is expressed by the following Inequation (1). At the sealing position, a width W2 between one end of the sealing plate 230 and one end side of the pipe 220 is expressed by the following Inequation (2).

$$W1 \geq 1.5 \times L/\tan\theta \quad \text{Inequation (1)}$$

$$W2 \geq 1.5 \times L/\tan\theta \quad \text{Inequation (2)}$$

In the above Inequations (1) and (2), L denotes a distance between an outlet 224 and a sealing surface 232 at the sealing position. In addition, θ denotes the angle of repose of a deposit T.

As illustrated in FIG. 11, at the retraction position, a distance B (shortest distance) between the sealing surface 232 of the sealing plate 230 and the one end side of the pipe 220 is, for example, larger than or equal to the maximum particle size of the solid particles.

As described above, the rotation shaft 252 included in the moving unit 250 according to the fourth modification is included between the one end and the other end of the sealing plate 230. Therefore, in the fourth modification, the sealing plate 230 can be downsized.

Although the embodiment has been described with reference to the accompanying drawings, it is naturally understood that the present disclosure is not limited to the above embodiments. It is clear that those skilled in the art can conceive various modifications or variations within the scope described in the claims, and it is understood that they are naturally also within the technical scope of the present disclosure.

For example, in the above-described embodiment, the case where the flow rate adjustment device 200 includes the plurality of adjustment units 210A to 210C has been described as an example. However, the flow rate adjustment device 200 may include only one adjustment unit. In this case, the flow rate adjustment device 200 functions as an on-off valve that turns on and off the flow of solid particles.

In the above embodiment, the case where the inner diameters of the pipes 220 of the adjustment units 210A to 210C are different from each other has been described as an example. However, it is sufficient that the adjustment units 210A to 210C have mutually different flow path cross-sectional areas at least partially in the pipes 220. In the adjustment units 210A to 210C, it is sufficient that, in the inner diameters of the pipes 220, diameters of the thinnest portions be different. For example, the inner diameter of the pipe 220 of the adjustment unit 210A, the inner diameter of the pipe 220 of the adjustment unit 210B, and the inner diameter of the pipe 220 of the adjustment unit 210C may be made substantially equal to each other, and orifices having different hole diameters may be provided inside the respective pipes 220 of the adjustment units 210A to 210C.

In the above embodiment, the case where the moving units 250 rotate the sealing plates 230 has been described as an example. However, the moving directions of the moving units 250 are not limited as long as the sealing plates 230 can be moved to the sealing position and the retraction position.

Figure 12:
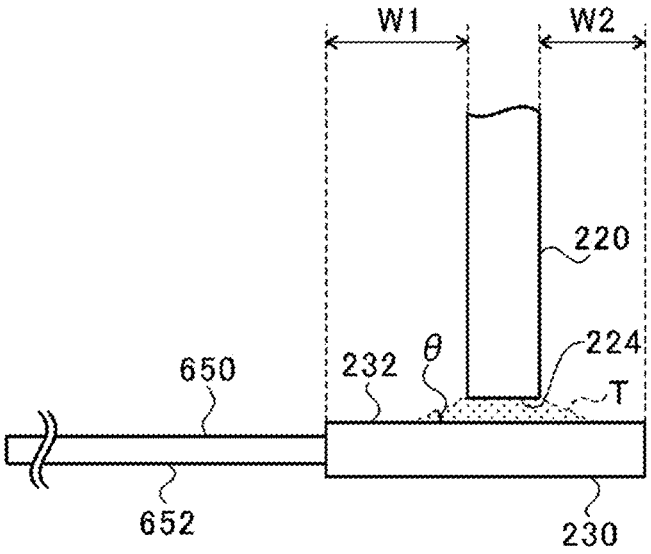
FIG. 12 is a diagram for explaining a moving unit according to a fifth modification at a sealing position.
Figure 13:
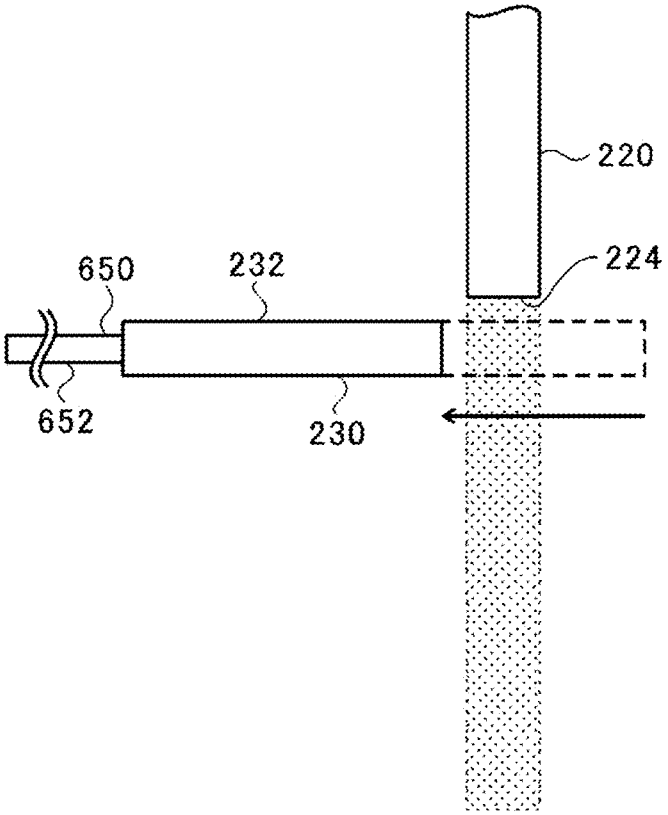
FIG. 13 is a diagram for explaining a moving unit according to the fifth modification at a retraction position.

FIG. 12 is a diagram for explaining a moving unit 650 according to a fifth modification at the sealing position. FIG. 13 is a diagram for explaining the moving unit 650 according to the fifth modification at the retraction position. As illustrated in FIGS. 12 and 13, for example, the moving unit 650 may move a sealing plate 230 in a substantially horizontal direction. As illustrated in FIGS. 12 and 13, in the fifth modification, the moving unit 650 includes an extensible rod 652 and an actuator (not illustrated). The extensible rod 652 is provided at one end of the sealing plate 230. The extensible rod 652 extends and contracts in the horizontal direction by the actuator (not illustrated). Therefore, the moving unit 650 linearly moves the sealing plate 230 in the horizontal direction. This can simplify the structure of the moving unit 650. Note that the actuator may be included in a communicating portion 204 or may be provided outside the communicating portion 204, similarly to the actuator included in the moving unit 250 of the above embodiment. Note that the actuator may be cooled (for example, water cooling).

In the above embodiment, the case where the moving units 250 rotate the sealing plates 230 in the up-down direction has been described as an example. However, the moving units 250 may rotate the sealing plates 230 in a substantially horizontal direction. In this case, the rotation shaft extends in a substantially vertical direction. In any case, the moving units 250 are only required to move the sealing plates 230 to the sealing position and the retraction position.

In the above embodiment, the case where the pipes 220 extend in the vertical direction has been described as an example. However, the pipes 220 are only required to have an outlet that is below an inlet and may be inclined.

What is claimed is:

1. A flow rate adjustment device comprising:

an adjustment unit including a pipe and a sealing plate provided below an outlet of the pipe, the sealing plate having a sealing surface; and a moving unit that moves the sealing plate to a sealing position where the sealing surface of the sealing plate is positioned vertically below the outlet of the pipe and a retraction position where the sealing surface of the sealing plate is retracted from a point vertically below the outlet of the pipe, the moving unit including an actuator, wherein when the sealing plate is moved from the retraction position to the sealing position by the moving unit, falling of solid particles downward from the outlet is stopped because the outlet is sealed by the solid particles deposited on the sealing surface, and when the sealing plate is moved from the sealing position to the retraction position by the moving unit, falling of the solid particles through the outlet is initiated because the solid particles deposited on the sealing surface fall off and sealing of the outlet by the solid particles is released.

2. The flow rate adjustment device according to claim 1, further comprising:

a plurality of the adjustment units, wherein flow path cross-sectional areas of the pipes of the plurality of adjustment units are at least partially different from each other.

3. The flow rate adjustment device according to claim 2, wherein a distance between the outlet of the pipe and the sealing surface of the sealing plate at the sealing position is larger than or equal to a maximum particle size of the solid particles.

4. The flow rate adjustment device according to claim 2, wherein the moving unit rotates the sealing plate.

5. The flow rate adjustment device according to claim 2, wherein the moving unit moves the sealing plate in a substantially horizontal direction.

6. The flow rate adjustment device according to claim 1, wherein a distance between the outlet of the pipe and the sealing surface of the sealing plate at the sealing position is larger than or equal to a maximum particle size of the solid particles.

7. The flow rate adjustment device according to claim 1, wherein the moving unit rotates the sealing plate.

8. The flow rate adjustment device according to claim 1, wherein the moving unit moves the sealing plate in a substantially horizontal direction.

9. The flow rate adjustment device according to claim 1, further comprising:

a control unit configured to control the moving unit so as to move the sealing plate from the sealing position to the retraction position and from the retraction position to the sealing position, thereby adjusting a flow rate of the solid particles falling from the outlet.

10. The flow rate adjustment device according to claim 9, further comprising:

a plurality of the adjustment units, wherein flow path cross-sectional areas of the pipes of the plurality of adjustment units are at least partially different from each other.

11. The flow rate adjustment device according to claim 10, wherein a distance between the outlet of the pipe and the sealing surface of the sealing plate at the sealing position is larger than or equal to a maximum particle size of the solid particles.

12. The flow rate adjustment device according to claim 10, wherein the moving unit rotates the sealing plate.

13. The flow rate adjustment device according to claim 10, wherein the moving unit moves the sealing plate in a substantially horizontal direction.

14. The flow rate adjustment device according to claim 9, wherein a distance between the outlet of the pipe and the sealing surface of the sealing plate at the sealing position is larger than or equal to a maximum particle size of the solid particles.

15. The flow rate adjustment device according to claim 9, wherein the moving unit rotates the sealing plate.

16. The flow rate adjustment device according to claim 9, wherein the moving unit moves the sealing plate in a substantially horizontal direction.

* * * * *